US008800304B2

(12) United States Patent
Koyama

(10) Patent No.: US 8,800,304 B2
(45) Date of Patent: Aug. 12, 2014

(54) CRYOPUMP CONTROL APPARATUS, CRYOPUMP SYSTEM, AND METHOD FOR MONITORING CRYOPUMP

(75) Inventor: Tomohiro Koyama, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 146 days.

(21) Appl. No.: 13/495,675

(22) Filed: Jun. 13, 2012

(65) Prior Publication Data

US 2012/0317999 A1 Dec. 20, 2012

(30) Foreign Application Priority Data

Jun. 14, 2011 (JP) ..... 2011-132685

(51) Int. Cl.
*B01D 8/00* (2006.01)

(52) U.S. Cl.
USPC ..... 62/55.5

(58) Field of Classification Search
USPC ..... 62/55.5, 56, 129, 172
See application file for complete search history.

(56) References Cited

U.S. PATENT DOCUMENTS

| | | | | | |
|---|---|---|---|---|---|
| 4,295,338 | A * | 10/1981 | Welch | 62/55.5 |
| 5,001,903 | A * | 3/1991 | Lessard et al. | 62/55.5 |
| 5,855,118 | A * | 1/1999 | Lorimer | 62/55.5 |
| 2005/0155358 | A1 * | 7/2005 | Ash et al. | 62/55.5 |
| 2007/0256429 | A1 * | 11/2007 | Fukuda | 62/55.5 |

FOREIGN PATENT DOCUMENTS

| | | | |
|---|---|---|---|
| JP | H04-501751 | A | 3/1992 |
| JP | 09-166078 | A | 6/1997 |
| WO | WO-90/02878 | A2 | 3/1990 |

* cited by examiner

*Primary Examiner* — Melvin Jones
(74) *Attorney, Agent, or Firm* — Rader, Fishman & Grauer PLLC

(57) ABSTRACT

A cryopump comprises a cryopanel that cools and thus condenses or adsorbs gas, and a pump housing that contains the cryopanel. a regeneration process of the cryopump includes a basic purge process, an evacuation processes, and an optional purge process that is executed additionally if required. The optional purge process includes one or more gas purge steps. In a cryopump control apparatus that controls the cryopump, a deterioration evaluation unit determines whether a re-purge number, which is the total number of gas purge steps that are required to be executed in one regeneration process, reaches a deterioration evaluation criteria number.

7 Claims, 8 Drawing Sheets

CRYOPUMP CONTROL APPARATUS, CRYOPUMP SYSTEM, AND METHOD FOR MONITORING CRYOPUMP

BACKGROUND OF THE INVENTION

1. Field of the Invention

Technical Field

The present invention generally relates to vacuum technology, and more particularly, to a cryopump control apparatus, a cryopump system, and a method for monitoring a cryopump.

2. Description of the Related Art

Background Art

A cryopump is a vacuum pump that attains a clean high vacuum environment, and is utilized, for example, to maintain a high vacuum in a vacuum chamber used in a semiconductor circuit manufacturing process. A cryopump accumulates gas by condensing or adsorbing gas molecules on cryopanels cooled to an ultra cold temperature by a refrigerator so as to exhaust gas from a vacuum chamber.

If cryopanels are covered by gases that have been condensed and converted to solid state, or if adsorbents of the cryopump have adsorbed gases almost to its maximum adsorption capacity, the pumping capability of the cryopump decreases. Thus, a regeneration process for removing condensed gases out of the cryopump is executed as appropriate. In the regeneration process, the temperature of cryopanels is raised so that the gases accumulated in the cryopump are liquefied or evaporated and discharged, accordingly. After the regeneration process, the cryopanels are cooled to an ultra cold temperature so that the cryopump can be used again.

SUMMARY OF THE INVENTION

According to an aspect of the present invention, a cryopump control apparatus is provided. The cryopump control apparatus controls a cryopump that includes a cryopanel which cools and thus condenses or adsorbs gas, and a pump housing which contains the cryopanel. The regeneration process of the cryopump includes: a basic purge process that includes one or more gas purge steps; one or more evacuation processes that first evacuate the pump housing down to a vacuum retention evaluation level and evaluate a vacuum retention state; and an optional purge process that includes one or more gas purge steps executed once or more than once if necessary. The cryopump control apparatus includes a deterioration evaluation unit operative to determine whether a re-purge number, which is the total number of one or more gas purge steps included in one or more optional purge processes that is required to be executed in one regeneration process, reaches a deterioration evaluation criteria number.

According to another aspect of the present invention, a cryopump system is provided. The cryopump system includes a cryopump and a cryopump control apparatus that controls the cryopump. The cryopump includes a cryopanel which cools and thus condenses or adsorbs gas, and a pump housing which contains the cryopanel. The regeneration process of the cryopump includes: a basic purge process that includes one or more gas purge steps; one or more evacuation processes that first evacuate the pump housing down to a vacuum retention evaluation level and evaluate a vacuum retention state; and an optional purge process that includes one or more gas purge steps executed once or more than once if necessary. The cryopump control apparatus includes a deterioration evaluation unit operative to determine whether a re-purge number, which is the total number of one or more gas purge steps included in one or more optional purge processes that is required to be executed in one regeneration process, reaches a deterioration evaluation criteria number.

According to another aspect of the present invention, a method for monitoring a cryopump is provided. The cryopump includes a cryopanel which cools and thus condenses or adsorbs gas, and a pump housing which contains the cryopanel. The regeneration process of the cryopump includes: a basic purge process that includes one or more gas purge steps; one or more evacuation processes that first evacuate the pump housing down to a vacuum retention evaluation level and evaluate a vacuum retention state; and an optional purge process that includes one or more gas purge steps executed once or more than once if necessary. The method includes determining whether a re-purge number, which is the total number of one or more gas purge steps included in one or more optional purge processes that is required to be executed in one regeneration process, reaches a deterioration evaluation criteria number.

Optional combinations of the aforementioned constituting elements, and implementations of the invention in the form of methods, apparatuses, systems, recording mediums, computer programs, or the like may also be practiced as additional modes of the present invention.

DETAILED DESCRIPTION OF THE INVENTION

Mode for Carrying Out the Invention

The invention will now be described by reference to the preferred embodiments. This does not intend to limit the scope of the present invention, but to exemplify the invention.

In order to continue using a cryopump in a good condition, maintenance such as an overhaul or the like is required in addition to the regeneration process. When determining the frequency or the timing of maintenance, for example, the number of use, or the hour of use can be used as a guideline. However, the deterioration status and/or the degree of contamination of respective components of cryopumps differs depending on usage conditions. Thus, appropriate timing for maintenance can not be determined uniformly.

Due to the maintenance of a cryopump, downtime during which a vacuum chamber is unavailable is increased, thus the rate of operation of a vacuum processing system is decreased. Therefore, the frequency of maintenance is preferably suppressed to its minimum. However, in case that the deterioration of the components of a cryopump proceeds faster than expected, there is a possibility that an unexpected trouble occurs before a periodic performance check or before an overhaul, which causes sudden downtime to a vacuum apparatus. Such a trouble causes an adverse impact on a production schedule.

One of exemplary purposes of an embodiment of the present invention is to provide a cryopump control apparatus, a cryopump system, and a method for monitoring a cryopump for efficiently keeping track of the deterioration of the cryopump.

First, a general description will be given on an exemplary embodiment of the present invention. In order to efficiently keep track of deterioration status of a cryopump, it is preferable to install a monitoring function or a self-checking function on a cryopump system so as to monitor the operation status of the cryopump. The present inventor has attained an idea that deterioration status of a cryopump can be monitored and appropriate timing for maintenance can be obtained by using a regeneration process that is executed as part usual operation so as to monitor the operation of the cryopump.

Figure 1:
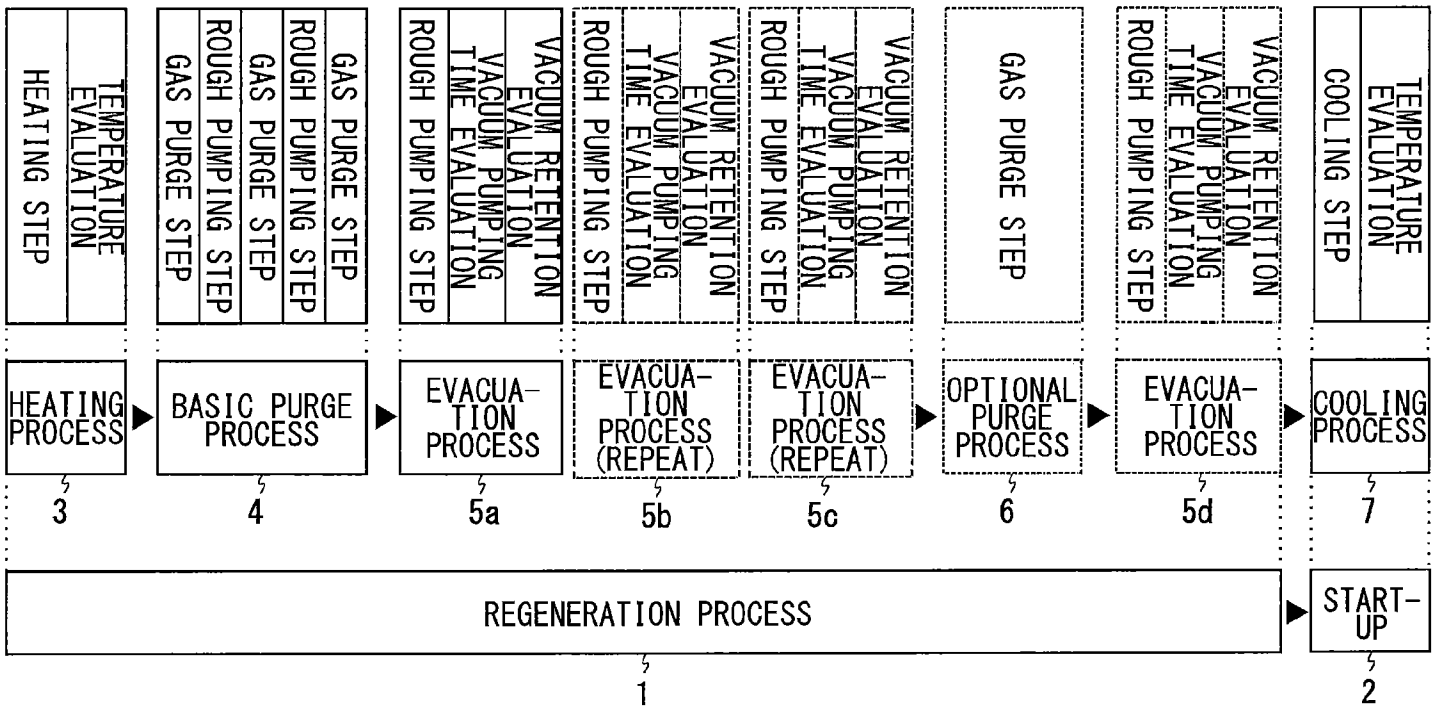
FIG. 1 shows a regeneration process of a cryopump according to an exemplary embodiment.

FIG. 1 shows a regeneration process 1 and a start-up process 2 of a cryopump according to an exemplary embodiment.

The regeneration process 1 includes a heating process 3, a purge process, and an evacuation process 5. In the heating process 3, gases accumulated in the cryopump are liquefied or evaporated. In the purge process, a gas used for purging (herein after also referred to as a "purge gas"), such as a nitrogen gas or the like, is introduced in order to facilitate the disengagement of gases condensed or adsorbed on cryopanels. In the evacuation process 5, gases are exhausted from the cryopump. The purge process includes a basic purge process 4, which should be executed in every regeneration process in principle, and an optional purge process 6, which is executed as necessary after the basic purge process. In case that a state after each process is determined not to satisfy a certain condition, the same process is executed repeatedly, or an additional process is executed. Processes shown with dashed line in FIG. 1 are executed only if necessary.

The heating process 3 includes a heating step and a temperature determination. In the heating step, cooling operation of the cryopump is stopped first. Then the cryopump may be kept as it is for a while, the cryopump may be heated by a heater, or adiabatic compression, which is caused by differentiating the timings of stroke of displacer in the refrigerator and timings of intake and discharge of operating gas from those of the cooling operation, may be used so that the temperature of cryopanels is increased to a regeneration temperature. The regeneration temperature is, for example, a temperature of a place where the cryopump is installed or a temperature close to the temperature (herein after also referred to as an "ambient temperature"). The ambient temperature may be, for example, about 300 K. The heating process 3 is continued until the measured temperature of the cryopanels reaches the regeneration temperature and if it is determined that the measured temperature reaches the regeneration temperature, the heating process 3 is completed.

The basic purge process 4 includes a predetermined number of gas purge steps and a predetermined number of rough-pumping steps. During the gas purge step, a purge gas is introduced into the cryopump 10. By the rough-pumping step, gases in the cryopump 10 are pumped out. According to the basic purge process 4 shown in FIG. 1, the gas purge step is repeated three times while executing the rough-pumping steps between the gas purge steps. The optional purge process 6 includes one gas purge step.

The basic purge process 4 and the optional purge process 6 have variations. For example, a gas purge step may be executed only once during the basic purge process 4, or a plurality of gas purge steps may be executed while executing one or more rough-pumping steps between the gas purge steps during the optional purge process 6.

After the basic purge process 4 and after the optional purge process 6, an evacuation process 5 is executed, respectively. The evacuation process 5 includes a rough pumping step, a vacuum pumping time evaluation, and a vacuum retention evaluation. In the rough pumping step, the cryopump 10 is evacuated. By the vacuum pumping time evaluation, it is determined whether the cryopump is pumped down to a predetermined degree of vacuum within a predetermined time period. By the vacuum retention evaluation, it is determined whether the degree of vacuum is maintained after stopping the pumping. In case that a further evacuation process 5 is determined to be required as the result of the vacuum retention evaluation, the evacuation process 5 is executed once more. In the example shown in FIG. 1, evacuation processes 5*a*, 5*b* and 5*c* are executed after the basic purge process 4, and an evacuation process 5*d* is executed after the optional purge process 6. In the description, each of the evacuation processes 5*a*-5*d* is also collectively referred to as a "evacuation process 5." As will be described later the evacuation process 5 may be executed in two steps, namely a first evacuation process that evacuates the cryopump to a first level and a second evacuation process that evacuates the cryopump to a second level.

If the evacuation process 5 has completed, the regeneration process 1 is over, and the cryopump can be used again after the start-up process 2 including the cooling process 7.

In the regeneration process 1, if a state after each process is determined not to satisfy a certain condition, the same process is executed repeatedly, or an additional process is executed. In such cases, the performance of the cryopump may be deteriorated. A cryopump control apparatus according to an exemplary embodiment detects the deterioration of the performance of the cryopump, for example by monitoring the number of the gas purge processes executed as the optional purge process 6.

Figure 2:
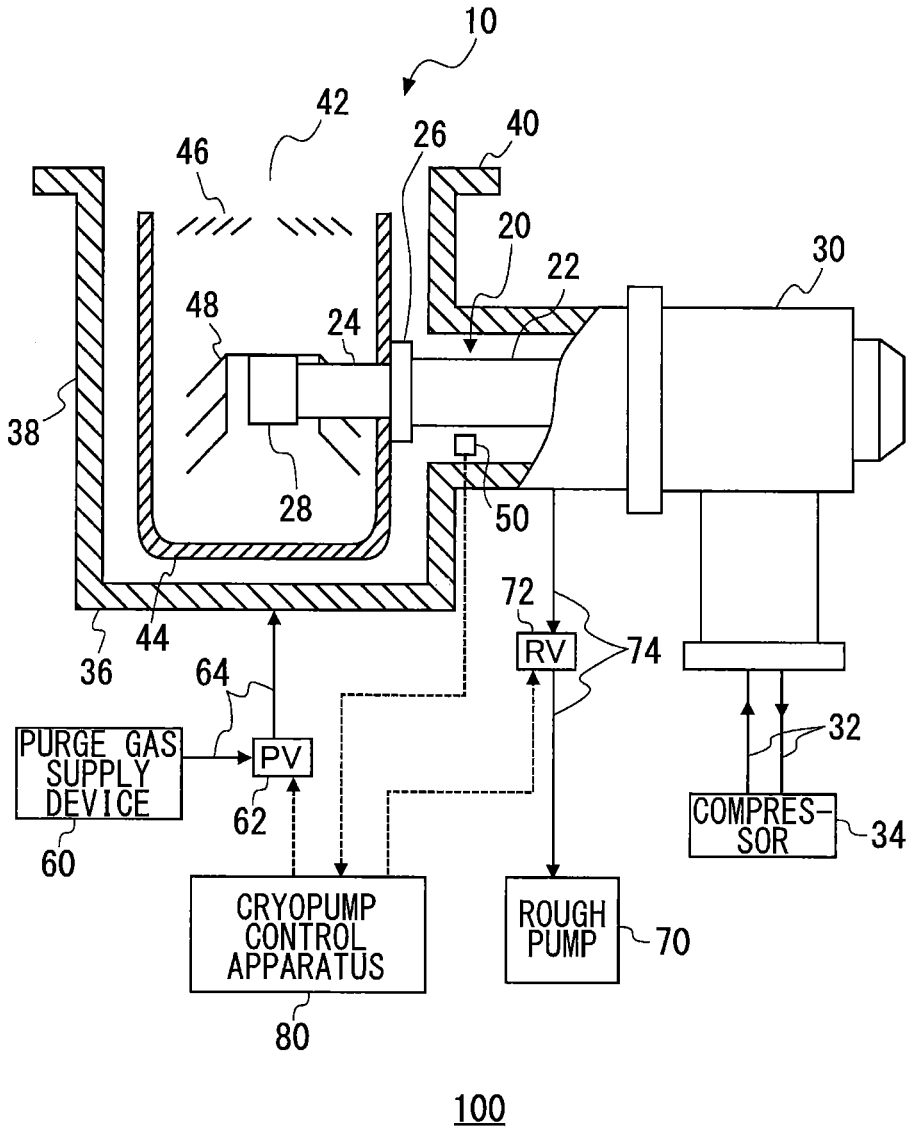
FIG. 2 schematically shows a cryopump system according to an exemplary embodiment.

By referring to figures, an explanation will be given below on the configuration of a cryopump system according to an exemplary embodiment of the present invention. FIG. 2 schematically shows a cryopump system 100 according to an exemplary embodiment. The cryopump system 100 comprises a cryopump 10, a compressor 34, a purge gas supply device 60, a rough pump 70, and a cryopump control apparatus 80. The cryopump 10 is mounted to a vacuum chamber of, for example, an ion implantation apparatus, a sputtering apparatus, or the like and used to increase the vacuum level inside the vacuum chamber to a level required by a desired process. The cryopump 10 includes a pump housing 36, a radiation shield 44, a cryopanel 48, and a refrigerator 20.

The refrigerator 20 is, for example, a Gifford-McMahon refrigerator (so-called GM refrigerator) or the like. The refrigerator 20 is provided with a first cylinder 22, a second cylinder 24, a first cooling stage 26, a second cooling stage 28, and a valve drive motor 30. The first cylinder 22 and the second cylinder 24 are connected in series. The first cooling stage 26 is installed on one end of the first cylinder 22 where the first cylinder 22 is connected with the second cylinder 24. The second cooling stage 28 is installed on the second cylinder 24 at the end that is farthest from the first cylinder 22. The refrigerator 20 shown in FIG. 2 is a two-stage refrigerator and achieves lower temperature by combining two cylinders in series. The refrigerator 20 is connected to a compressor 34 through a refrigerant pipe 32.

The compressor 34 compresses a refrigerant gas (i.e., an operating gas) such as helium or the like, and supplies the gas to the refrigerator 20 through the refrigerant pipe 32. While cooling the operating gas by allowing the gas to pass through a regenerator, the refrigerator 20 further cools the gas by expanding the gas first in an expansion chamber inside the first cylinder 22 and then in an expansion chamber in the second cylinder 24. Regenerators are installed inside the expansion chambers. Thereby, the first cooling stage 26 installed on the first cylinder 22 is cooled to a first cooling temperature level while the second cooling stage 28 installed on the second cylinder 24 is cooled to a second cooling temperature level lower than the first cooling temperature level. For example, the first cooling stage 26 is cooled to about 65-100 K, while the second cooling stage 28 is cooled to about 10-20 K.

The operating gas, which has absorbed heat by expanding in the respective expansion chambers sequentially and cooled respective cooling stages, passes through the regenerator again and is returned to the compressor 34 through the refrigerant pipe 32. The flow of the operating gas from the compressor 34 to the refrigerator 20 and from the refrigerator 20 to the compressor 34 are switched by a rotary valve (not shown) in the refrigerator 20. A valve drive motor 30 rotates the rotary valve with power supplied from an external power source.

The pump housing 36 has a portion 38 formed into a cylindrical shape (hereinafter, referred to as a "trunk portion 38"), one end of which being provided with an opening and the other end being closed. The opening of the pump housing 36 is provided as a pump inlet 42 for accepting a gas to be evacuated from a vacuum chamber of a vacuum apparatus, to which the cryopump is to be connected. The pump inlet 42 is defined by the interior surface of the upper end of the trunk portion 38 of the pump housing 36.

At the upper end of the trunk portion 38 of the pump housing 36, a mounting flange 40 extends outwardly in the radial direction. The cryopump 10 is mounted, by using the mounting flange 40 via a gate valve (not shown), to the vacuum chamber of the vacuum apparatus.

The pump housing 36 is provided in order to separate the inside of the cryopump 10 from the outside thereof. The pump housing 36 is airtight and the inside thereof is maintained at a common pressure. This allows the pump housing 36 to function as a vacuum vessel during the cryopump 10 operates to discharge gas. The exterior surface of the pump housing 36 is exposed to the environment outside the cryopump 10 during the operation of the cryopump 10, i.e., even during cooling operation of the refrigerator. Therefore the exterior surface of the pump housing 36 is maintained at a temperature higher than that of the radiation shield 44. The temperature of the pump housing 36 is typically maintained at an ambient temperature.

A pressure sensor 50 is provided in the pump housing 36. The pressure sensor 50 measures, periodically or when receiving an instruction, the internal pressure of the pump housing 36 and transmits a signal indicating the measured pressure to the cryopump control apparatus 80. The pressure sensor 50 and the cryopump control apparatus 80 are communicably connected with each other.

The pressure sensor 50 has a wide measurement range including both a high vacuum level attained by the cryopump 10 and the atmospheric pressure level. At least a pressure range, which can occur during a regeneration process 1, is included in the measurement range of the pressure sensor 50. Alternatively, a pressure sensor for measuring a vacuum level and that for measuring an atmospheric pressure level may be provided in the cryopump 10, separately.

The radiation shield 44 is arranged inside the pump housing 36. The radiation shield 44 is formed as a cylindrical shape, one end of which being provided with an opening and the other end being closed, that is, a cup-like shape. The trunk portion 38 of the pump housing 36 and the radiation shield 44 are both formed as substantially cylindrical shapes and are arranged concentrically. The inner diameter of the trunk portion 38 of the pump housing 36 is larger than the outer diameter of the radiation shield 44 to some extent. Therefore, the radiation shield 44 is arranged in the trunk portion 38 of the pump housing 36 without contact, spaced reasonably apart from the interior surface of the pump housing 36. That is, the outer surface of the radiation shield 44 faces the inner surface of the pump housing 36.

The radiation shield 44 is provided as a radiation shield to protect both the second cooling stage 28 and the cryopanel 48, which is thermally connected to the second cooling stage 28, from radiation heat mainly from the pump housing 36. The second cooling stage 28 is arranged inside the radiation shield 44, substantially on the central axis of the radiation shield 44. The radiation shield 44 is fixed to the first cooling stage 26 so as to be thermally connected to the stage, and the radiation shield 44 is cooled to a temperature comparable to that of the first cooling stage 26.

The cryopanel 48 includes a plurality of panels, each of the panels having a shape of the side surface of a truncated cone. The cryopanel 48 is thermally connected to the second cooling stage 28. Typically, an adsorbent such as activated charcoal or the like (not shown) is attached to the back surface (i.e., the surface further from the pump inlet 42) of respective panels of the cryopanel 48.

A baffle 46 is provided at the opening end of the radiation shield 44 in order to protect both the second cooling stage 28 and the cryopanel 48, which is thermally connected to the stage 28, from radiation heat emitted from a vacuum chamber or the like. The baffle 46 is formed as, for example, a louver structure or a chevron structure. The baffle 46 is thermally connected to the radiation shield 44 and cooled to a temperature comparable to that of the radiation shield 44.

The cryopump control apparatus 80 controls the refrigerator 20 based on the cooling temperature of the first cooling stage 26 or the second cooling stage 28. For this purpose, a temperature sensor (not shown) may be provided on the first cooling stage 26 or on the second cooling stage 28. The cryopump control apparatus 80 may control the cooling temperature by controlling the driving frequency of the valve drive motor 30. The cryopump control apparatus 80 also controls respective valves, which will be described later.

The pump housing 36 and the rough pump 70 are connected by a rough pipe 74. A rough valve 72 is provided in the rough pipe 74. The cryopump control apparatus 80 controls opening or closing of the rough valve 72 so as to open the passage through between the rough pump 70 and the cryopump 10 or to block the passage, respectively. The rough pump 70 is used in order to roughly evacuate the pump housing 36, for example as a preparation for starting pumping by the cryopump. By opening the rough valve 72 and by allowing the rough pump 70 to operate, the pump housing 36 can be evacuated by the rough pump 70.

The pump housing 36 and the purge gas supply device 60, which provides a gas used for purging, such as a nitrogen gas or the like, are connected by a purge gas pipe 64. A purge valve 62 is provided in the purge gas pipe 64. The opening or closing of the purge valve 62 is controlled by the cryopump control apparatus 80. By the opening or closing of the purge valve 62, the supply of the purge gas to the cryopump 10 is controlled.

The pump housing 36 may be connected to a vent valve (not shown) that functions as a so-called safety valve. The rough valve 72 and the purge valve 62 may be provided in the pump housing 36 at a location where the rough pipe 74 or the purge gas pipe 64 is connected with the pump housing 36.

When about to start the pumping operation of the cryopump 10, before starting the operation, pump housing 36 is first pumped by the rough pump 70 through the rough valve 72 down to about 1 Pa. The pressure is measured by the pressure sensor 50. Thereafter, the cryopump 10 is activated. By driving the refrigerator 20 under the control of the cryopump control apparatus 80, the first cooling stage 26 and the second cooling stage 28 are cooled, thereby the radiation shield 44, the baffle 46, and the cryopanel 48, which are thermally connected to the stages, are also cooled.

The cooled baffle 46 cools gas molecules flowing from the vacuum chamber into the cryopump 10 so that a gas whose vapor pressure is sufficiently low at the cooling temperature (e.g., water vapor or the like) will be condensed on the surface of the baffle 46. A gas whose vapor pressure is not sufficiently low at the cooling temperature of the baffle 46 enters into the radiation shield 44 through the baffle 46. Of the entering gas molecules, a gas whose vapor pressure is sufficiently low at the cooling temperature of the cryopanel 48 will be condensed on the surface of the cryopanel 48. A gas whose vapor pressure is not sufficiently low at the cooling temperature (e.g., hydrogen or the like) is adsorbed by an adsorbent, which adheres to the surface of the cryopanel 48 and is cooled. In this way, the cryopump 10 can attain a desired degree of vacuum in a vacuum chamber to which the pump is mounted.

The regeneration process 1 of the cryopump 10 is executed if a predetermined time period has been passed after starting a pumping operation or if deterioration of performance resulting from the accumulation of exhausted gas on the cryopanel 48 is observed. The regeneration process 1 of the cryopump 10 is controlled by the cryopump control apparatus 80.

Figure 3:
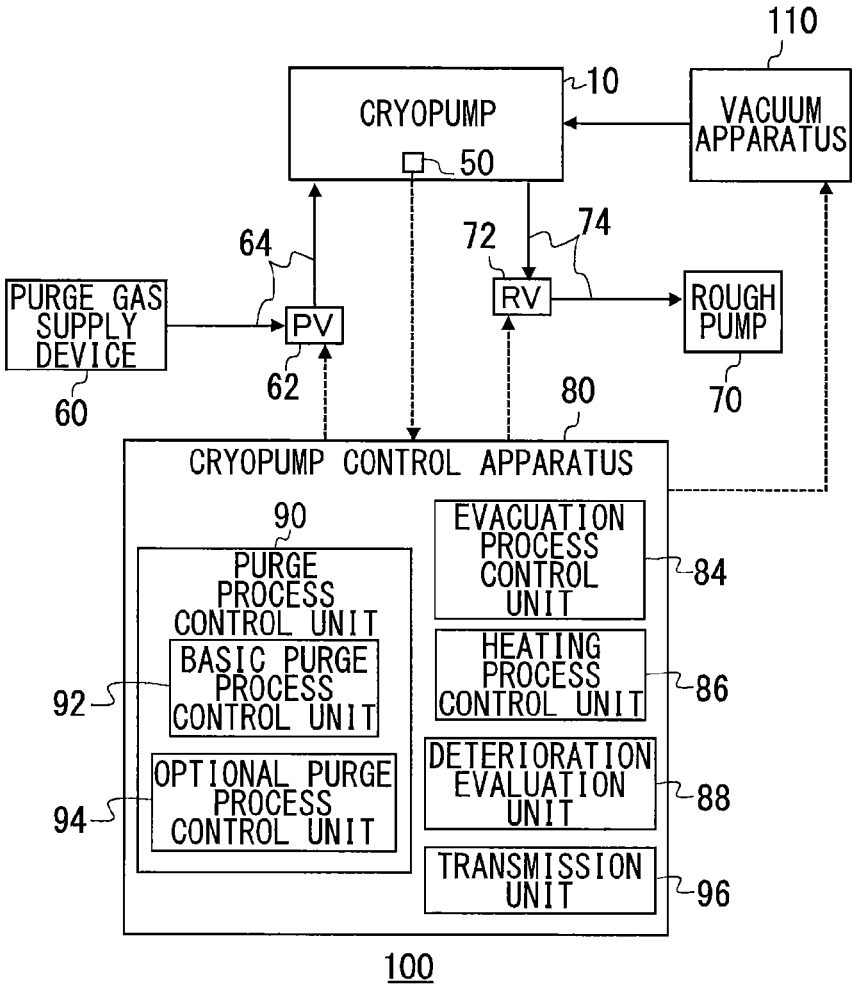
FIG. 3 schematically shows a cryopump system according to an exemplary embodiment.

FIG. 3 schematically shows a cryopump system 100 according to an exemplary embodiment. The cryopump system 100 may be configured to include a vacuum apparatus 110 to which the cryopump is connected. For the aforementioned constituting elements, a same referential number is attached also in FIG. 3, and the explanation thereof is omitted. FIG. 3 shows the structure of the cryopump control apparatus 80, particularly a structure related to the regeneration process 1. The cryopump control apparatus 80 comprises a heating process control unit 86, a purge process control unit 90, an evacuation process control unit 84, a deterioration evaluation unit 88, and a transmission unit 96. In the cryopump system 100, an I/O module (not shown) may be provided between the cryopump control apparatus 80 and an apparatus that is controlled by the cryopump control apparatus 80, and the cryopump control apparatus 80 may be installed at a distant location.

When about to start the regeneration process 1 of the cryopump 10, the heating process control unit 86 stops the cooling operation of the refrigerator 20 and starts a heating operation. The heating process control unit 86 rotates the rotary valve in the refrigerator 20 in a reverse direction from that of the cooling operation so as to differentiate timings of intake and discharge of operating gas from those of the cooling operation in order to cause adiabatic compression to the operating gas. Compression heat obtained in this manner heats the cryopanel 48. The heating process control unit 86 acquires a measured value of the temperature in the pump housing 36 from a temperature sensor (not shown) provided in the cryopump 10. If the measured value reaches a regeneration temperature, the heating process control unit 82 finishes the heating process.

The purge process control unit 90 comprises a basic purge process control unit 92 and an optional purge process control unit 94. After the heating process is completed, the basic purge process control unit 92 starts a gas purge step by closing the rough valve 72 and by opening the purge valve 62. When a predetermined time period has elapsed after the gas purge step is started or when the pressure reaches a predetermined value, the basic purge process control unit 92 finishes the gas purge step and starts a rough pumping step by closing the purge valve 62 and by opening the rough valve 72. When a predetermined time period has elapsed after the rough pumping step is started or when the pressure reaches a predetermined value, the basic purge process control unit 92 starts another gas purge step by opening the purge valve 62 and by closing the rough valve 72. In this manner, the basic purge process control unit 92 executes gas purge steps included in the basic purge process 4 repeatedly for a predetermined number of times while executing one or more rough-pumping steps between the gas purge steps.

The optional purge process control unit 94 determines whether or not the optional purge process 6 is required, and upon determining to execute the optional purge process 6, the optional purge process control unit 94 controls opening or closing of the purge valve 62 and the rough valve 72 so as to execute the optional purge process 6. The optional purge process 6 includes one gas purge step, which for example introduces a purge gas for 30 seconds. The optional purge process 6 may include a plurality of gas purge steps and one or more rough-pumping step executed between the gas purge steps. In the description, a gas purge step executed as the optional purge process 6 is also referred to as a "re-purge step" or "re-purge."

After the purge process is completed, the evacuation process control unit 84 evacuates a purge gas introduced during the purge process and a gas that is re-evaporated from the surface of the cryopanels by the purge process to the outside of the cryopump 10 by using the rough pump 70. Then the evacuation process control unit 84 determines whether or not a pressure value measured in the cryopump 10 and acquired from the pressure sensor 50 satisfies a predetermined vacuum condition, and upon determining that the vacuum condition is satisfied, the evacuation process control unit 84 finishes the evacuation process 5. In order to exhaust gases from the cryopump 10 to the outside, a vent valve (not shown) may be used when the pressure in the pump housing 36 is higher than the atmospheric pressure level, for example during the purge step or the like, and the rough pump 70 may be used when the pressure in the pump housing 36 is lower than the atmospheric pressure level.

The evaluation of vacuum condition includes a vacuum pumping time evaluation, and a vacuum retention evaluation. By the vacuum pumping time evaluation, it is determined whether the cryopump is pumped down to a predetermined pressure within a predetermined time period after starting pumping by opening the rough valve 72. By the vacuum retention evaluation, it is determined whether rise of pressure when a predetermined time period has passed after stopping the pumping is within a predetermined allowable range. In the vacuum pumping time evaluation, if the evacuation process control unit 84 determines that the cryopump has not been pumped down to a predetermined pressure within a predetermined time period after starting pumping (i.e., determines that the vacuum pumping time condition is not met), the evacuation process control unit 84 determines to execute an optional purge process 6. If the evacuation process control unit 84 determines that the vacuum pumping time condition is met, the evacuation process control unit 84 executes the vacuum retention evaluation, subsequently.

In the vacuum retention evaluation, the evacuation process control unit 84 closes the rough valve 72 so as to stop pumping if the pressure in the pump housing 36 reaches a pressure level for starting the vacuum retention evaluation, and determines whether or not rise of pressure when a predetermined time period has passed is within a predetermined allowable range. In case that the rise of pressure when the predetermined time period has passed is beyond the allowable range, the evacuation process control unit 84 determines that the vacuum retention condition is not satisfied, and executes another evacuation process 5. On the other hand, in case that the rise of pressure when the predetermined time period has passed is within the allowable range, the evacuation process control unit 84 determines that the vacuum retention condition is satisfied, and finishes the evacuation process 5. If the evacuation process 5 is completed, the regeneration process 1 is over, and the cooling process 7 of the start-up process 2 of the cryopump 10 is started.

The optional purge process control unit 94 determines whether or not the optional purge process 6 is required. More specifically, the optional purge process control unit 94 determines to execute an optional purge process 6 in case that a sequential evacuation process execution number, which is the number of times that the evacuation process 5 is executed repeatedly in sequence (i.e., the count of sequential execution of the evacuation process 5), reaches an additional purge requiring criteria number, which is determined in advance.

In case that a small amount of remained gases are attached to the cryopanel 48 even after the execution of a basic purge process 4 and an evacuation process 5, the remained gases can be exhausted from the cryopump 10 by repeating the evacuation process 5 several times. However, in case that a large amount of remained gases are attached to the cryopanel 48, or the gases are attached in a state where gases are difficult to be disengaged, the remained gases can be often exhausted quicker with one time execution of the optional purge process 6 than repeating the evacuation process 5 several times.

The additional purge requiring criteria number is determined so that an average time required for the regeneration process 1 becomes shorter. For example, the additional purge requiring criteria number may be determined within the range of 1-20 times, or may be determined within the range of 5-10 times. The additional purge requiring criteria number may be determined based on experience or by experiment since an optimal additional purge requiring criteria number may vary depending on usage statuses of the cryopump 10, types of gases to be evacuated, or the like.

The deterioration evaluation unit 88 determines whether a total number of gas purge steps included in one or more optional purge processes 6 that is required to be executed in one regeneration process 1 (herein after also referred to as a "re-purge number" or a "re-purge count") is more than or equal to a deterioration evaluation criteria number. In case that it is determined that the vacuum condition is not met even after an optional purge process 6 is executed, and yet another optional purge process 6 is required, a part of the cryopump may be deteriorated.

Therefore, by monitoring the re-purge number, a possibility of deterioration of a part or a component of the cryopump can be detected in advance. As a result, the possibility of deterioration can be addressed appropriately at the next maintenance opportunity, or if necessary, operation of the cryopump can be stopped for an inspection. Thus, the purpose of the invention described above can be achieved.

The deterioration evaluation criteria number refers to a re-purge number that is significantly larger than the number of re-purge steps usually executed during one regeneration process 1, and with which deterioration of a part or a component of the cryopump 10 is suspected. The deterioration evaluation criteria number may be defined as a number that is larger by one or two than the re-purge number of a state where no problem is detected with the cryopump 10. The deterioration evaluation criteria number may be, for example, two to four.

The deterioration evaluation criteria number may be defined as a number which is the addition of an extra number to the number of re-purge steps executed during one regeneration process 1, which is averaged during a certain monitoring period (e.g., one-week to one-month) after a new cryopump 10 starts operation. In defining the averaged number of re-purge steps, a certain period (e.g., about one to two weeks) after a new cryopump 10 is connected to a vacuum apparatus and starts operation may be omitted from the monitoring period for counting re-purge numbers. In this case, re-purge numbers during a certain period after the omitted period may be counted and used for calculating the averaged number.

In this manner, the deterioration evaluation criteria number may be defined by using a cryopump 10, which is used actually, and by using the averaged re-purge number counted in an actual environment for using the cryopump 10, thereby individual difference among cryopumps 10 and a use environment can be reflected in the determination criteria, and a deterioration can be detected and favorable maintenance timing can be estimated more accurately. The deterioration evaluation criteria number may be determined based on experience or by experiment since an optimal deterioration evaluation criteria number may vary depending on usage statuses, types of gases to be evacuated, or the like.

The deterioration evaluation unit 88 may determine whether a re-purge number average for most recent plurality of regeneration processes 1 is more than or equal to a deterioration evaluation criteria number. The increment in re-purge number in a regeneration process 1 may result not only from the deterioration of the cryopump 10 but also from various parameters, such as, operating time, types or quantity of gases to be evacuated, or the like. Therefore, even if the re-purge number of a certain regeneration process 1 is more than or equal to a deterioration evaluation criteria number, this does not necessarily mean that maintenance is required. However, if there is a tendency that the re-purge number of a regeneration process 1 is often more than or equal to a deterioration evaluation criteria number when monitoring a plurality of regeneration processes 1 continuously, there may be a high likelihood of deterioration of the cryopump 10, thus maintenance may be highly required.

By using a re-purge number average for most recent plurality of regeneration processes 1, deviation of re-purge number resulted from other than deterioration is canceled out and a possibility of deterioration of the cryopump 10 can be detected more accurately. The number of most recent plurality of regeneration processes 1 (herein after also referred to as a "accumulation number") may be a number with which the deviation of re-purge number can be sufficiently canceled, for example, about two to ten. The accumulation number may be determined based on experience or by experiment since an optimal accumulation number may vary depending on usage situations of the cryopump 10, for example types and/or quantity of gases to be evacuated for respective uses, or the like.

In case that the deterioration evaluation unit 88 determines that a re-purge number reaches the deterioration evaluation criteria number, the transmission unit 96 sends a warning signal to the vacuum apparatus 110. In the description, the vacuum apparatus 110 includes not only an apparatus having a vacuum chamber that is directly connected with the cryopump 10, but also an apparatus for controlling the apparatus having the vacuum chamber. Thereby, the status of the cryopump 10 can be appropriately notified to a user of the vacuum apparatus 110, which is affected when the cryopump 10 suddenly goes out of order, etc.

Alternatively or in addition, the transmission unit 96 may send a warning signal to a displaying unit (not shown) provided in the main body of the cryopump control apparatus 80, or to a display device (not shown) connected to the cryopump control apparatus 80, and may allow the displaying unit or display device to display the warning. Thereby, the status of the cryopump 10 can be notified directly to a user who is near the cryopump control apparatus 80.

The warning signal transmitted by the transmission unit 96 may include information on degree of urgency. For example, the information on degree of urgency may defined so that the degree of urgency becomes higher as a difference between a re-purge number and the deterioration evaluation criteria number becomes larger in case that the re-purge number is more than or equal to the deterioration evaluation criteria number. This provides a user or an apparatus with information for making appropriate decision regarding whether or not maintenance is required and/or regarding maintenance timing.

Upon receiving the warning transmitted from the transmission unit 96, the vacuum apparatus 110 executes a predetermined process. The predetermined process may be a process for calling attention of a user, for example by displaying a warning message, or sounding a beep tone. Alternatively, the predetermined process may be a process for stopping the operation of the vacuum apparatus 110 safely so as not to cause an adverse impact on a product, a prototype, experimental material, or the like. In case that a warning includes information on degree of urgency, the vacuum apparatus 110 may execute various processes depending on the information on degree of urgency. That is, the vacuum apparatus 110 may execute the process for calling attention of a user in case of receiving a warning with low degree of urgency, and may execute the process for stopping operation in case of receiving a warning with high degree of urgency.

This allows a user or an apparatus using the cryopump to deal with a problem more quickly in case there is a possibility of deterioration of the cryopump 10. This suppresses the occurrence of sudden downtime of a vacuum apparatus, and/or suppresses an adverse impact that the cryopump may cause to a vacuum process.

Figure 4:
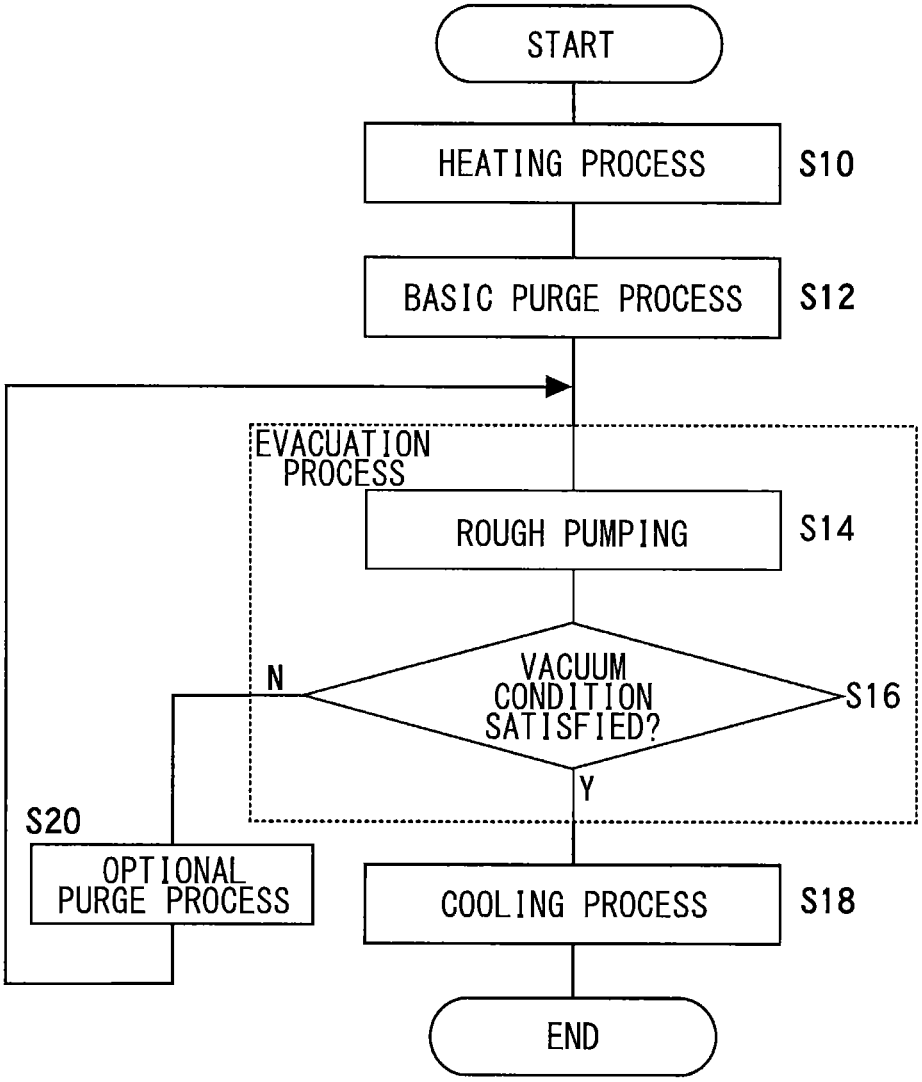
FIG. 4 shows a flowchart indicating a regeneration process and a subsequent start-up process of a cryopump according to an exemplary embodiment.

An explanation on the operation with the aforementioned configuration will be given below. FIG. 4 shows a regeneration process 1 and a subsequent start-up process 2 of the cryopump 10. First, the heating process control unit 86 executes the heating process 3 (S10). Subsequently, the basic purge process control unit 92 executes the basic purge process 4 (S12). In the basic purge process 4, a predetermined number of gas purge steps are executed while executing one or more rough-pumping steps between the gas purge steps.

The evacuation process control unit 84 executes the evacuation process 5 thereafter. The evacuation process 5 includes the rough pumping step and the vacuum condition evaluation. In the rough pumping step, the cryopump 10 is evacuated (S14). In the vacuum condition evaluation, whether the evacuation process 5 is completed is determined (S16) by the vacuum pumping time evaluation and by the vacuum retention evaluation. In case that the vacuum condition is not satisfied (N in S16), the optional purge process control unit 94 executes an optional purge process 6 (S20). Then the process 5 is executed again (S14 and S16). In case that the vacuum condition is satisfied (Y in S16), the evacuation process 5 completes. Accordingly, the refrigerator 20 starts cooling operation and cools the cryopanel 48 again (S18). If the cooling process 7 has completed, the pumping operation of the cryopump 10 can be started again.

Figure 5:
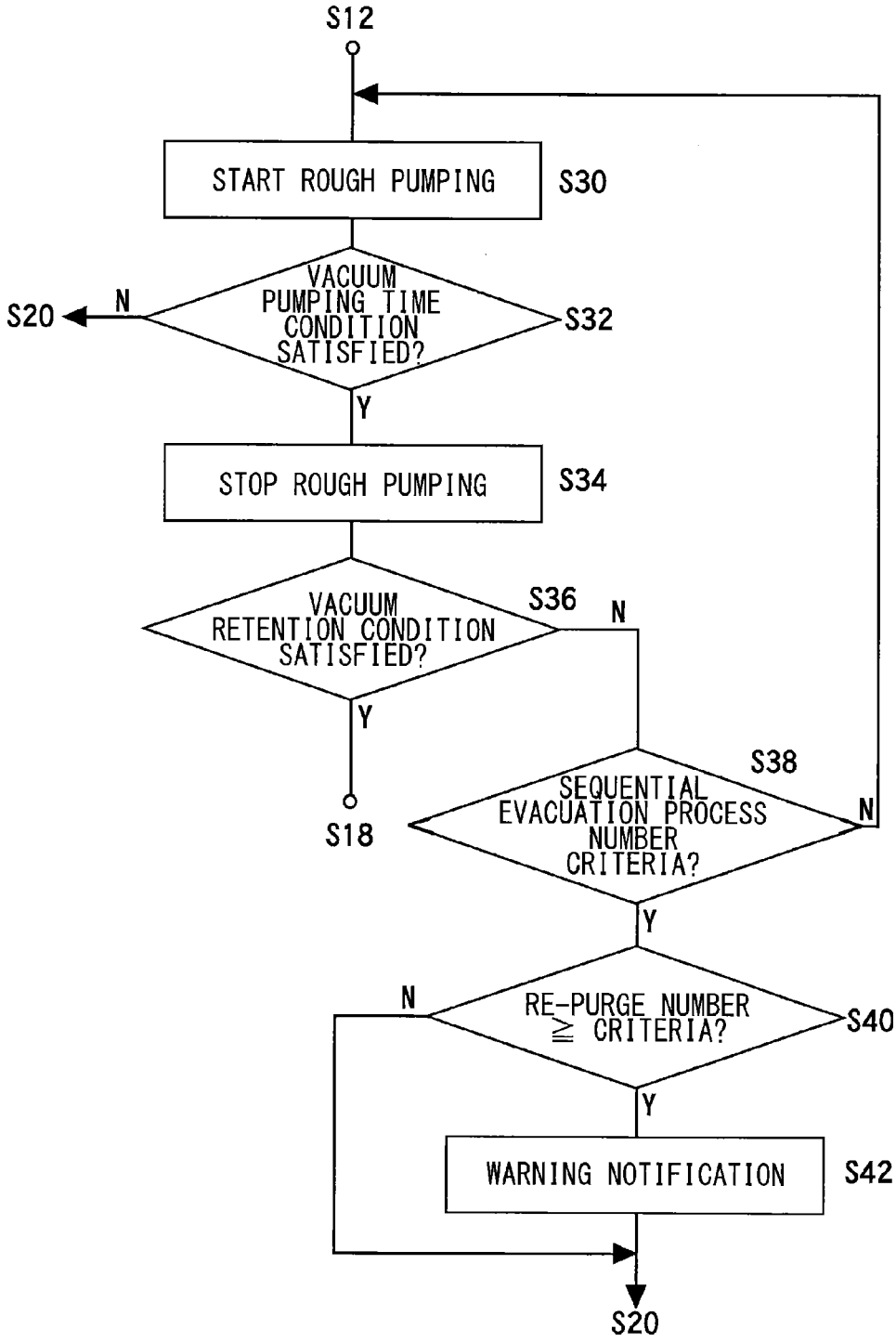
FIG. 5 shows a flowchart indicating in detail an evacuation process of a regeneration process of a cryopump according to an exemplary embodiment.

FIG. 5 shows an evacuation process 5 of the regeneration process 1 of the cryopump 10 in detail.

The evacuation process control unit 84 opens the rough valve 72 and allows the rough pump 70 to start pumping the pump housing 36 in order to discharge a purge gas or re-evaporated gases from the cryopump 10 (S30). The evacuation process control unit 84 executes the vacuum pumping time evaluation, which determines whether the inside of the cryopump 10 is pumped down to a predetermined pressure by the time when a predetermined time period has elapsed after starting pumping (S32).

In case the evacuation process control unit 84 determines that the vacuum pumping time condition is not satisfied (N in S32), the optional purge process control unit 94 executes an optional purge process 6 (S20 in FIG. 4). In case the evacuation process control unit 84 determines that the vacuum pumping time condition is satisfied (Y in S32), the evacuation process control unit 84 closes the rough valve 72 so as to stop the pumping (S34). Subsequently, the evacuation process control unit 84 executes the vacuum retention evaluation (S36).

In case that the rise of pressure when the predetermined time period has passed is beyond the allowable range, the evacuation process control unit 84 determines that the vacuum retention condition is not satisfied (N in S36). In this case, the optional purge process control unit 94 determines whether or not the optional purge process 6 is required on the basis of the sequential execution number of the evacuation process 5 (S38). In case that the sequential execution number of the evacuation process 5 has not reached the additional purge requiring criteria number (N in S38), the optional purge process control unit 94 determines not to execute an optional purge process 6, and the evacuation process control unit 84 executes the evacuation process 5 once more (S30).

On the other hand, in case that the sequential execution number of the evacuation process 5 has reached the additional purge requiring criteria number (Y in S38), the optional purge process control unit 94 determines to execute an optional purge process 6. The deterioration evaluation unit 88 determines whether or not a re-purge number in the regeneration processes 1 is more than or equal to the deterioration evaluation criteria number (S40). If the re-purge number is more than or equal to the deterioration evaluation criteria number (Y in S40), the transmission unit 96 sends a warning to the vacuum apparatus 110 and the optional purge process control unit 94 executes an optional purge process 6 (S20 in FIG. 4). If the re-purge number has not reached the deterioration evaluation criteria number (N in S40), no warning is sent. Also in this case, the optional purge process control unit 94 executes an optional purge process 6 (S20 in FIG. 4).

In case the evacuation process control unit 84 determines that the vacuum retention condition is satisfied (Y in S36), the evacuation process control unit 84 finishes the evacuation process 5. Thereby the regeneration process 1 completes, and the cooling process 7 of the start-up process 2 of the cryopump 10 is started (S18 in FIG. 4).

In this manner, according to the exemplary embodiment, deterioration status of the cryopump 10 can be monitored by using a regeneration process 1 that is executed as a part of usual operation cycle of the cryopump 10.

In the process where the deterioration evaluation unit 88 counts the number of re-purge steps in the regeneration process 1, re-purge steps may be classified by the reason why the optional purge process 6 is required, and the deterioration evaluation unit 88 may count the number of re-purge steps for respective classified groups. The deterioration may be determined by using the number of re-purge steps of one of the groups, or all of the groups. That is: a) the number of gas purge steps (herein after also referred to as a "vacuum pumping time resulted re-purge") of optional purge process 6 that is determined to be necessary because the vacuum pumping time evaluation criteria is not satisfied (N in S32); and b) the number of gas purge steps (herein after also referred to as a "consecutive evacuation resulted re-purge") of optional purge process 6 that is determined to be necessary because more than or equal to predetermined number of evacuation processes 5 are executed consecutively may be counted separately. In this case, different deterioration evaluation criteria numbers may be defined for the vacuum pumping time resulted re-purge and for the consecutive evacuation resulted re-purge.

In this case, not only the necessity of maintenance is detected, but also possible defect parts in the cryopump 10 can be narrowed down.

Figure 6:
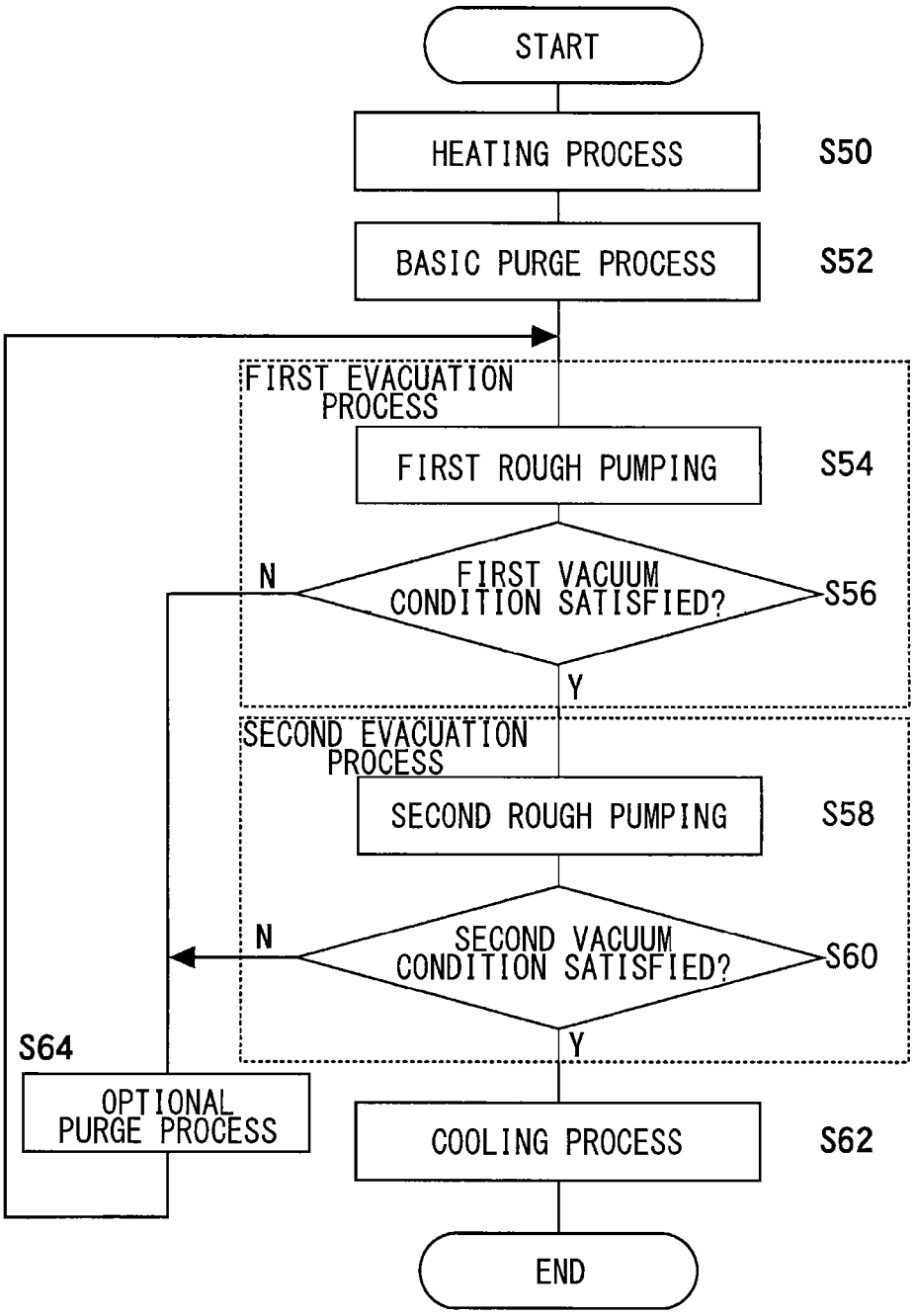
FIG. 6 shows a flowchart indicating a variation of a regeneration process and a subsequent start-up process of a cryopump according to an exemplary embodiment.

FIG. 6 shows a variation of a regeneration process 1 and a subsequent start-up process 2 of the cryopump 10 according to an exemplary embodiment. Although the variation of a regeneration process 1 also has a similar configuration as that shown in FIG. 1, the evacuation process 5 includes a first evacuation process and a second evacuation process.

During the first evacuation process, the inside of the cryopump 10 is evacuated, starting from the pressure in the cryopump 10 when the purge process is executed, to a first pressure level. During the second evacuation process, the inside of the cryopump 10 is evacuated from the first pressure level to a second pressure level, which is the pressure in the cryopump 10 when activating the cryopump 10 (herein after also referred to as a "base pressure"). The first pressure level is lower than the pressure in the cryopump 10 when the purge process is executed and higher than the base pressure. In the description the first pressure level is also referred to as a "medium pressure."

During the regeneration process 1, the heating process control unit 86 first executes the heating process 3 (S50). Subsequently, the basic purge process control unit 92 executes the basic purge process 4 (S52). In the basic purge process 4, a plurality of gas purge steps are executed while executing one or more rough-pumping steps between the gas purge steps.

Subsequently, the evacuation process control unit 84 executes the first evacuation process. The first evacuation process includes a first rough pumping step (S54) and a first vacuum condition evaluation (S56). By the first rough pumping step, the cryopump 10 is evacuated from the pressure in the cryopump 10 when the purge process is executed to about the medium pressure. By the first vacuum condition evaluation, whether the first evacuation process is completed is determined by a first vacuum pumping time evaluation and by a first vacuum retention evaluation. In case that the first vacuum condition is not satisfied (N in S56), the optional purge process control unit 94 executes an optional purge process 6 (S64). In case that the first vacuum condition is satisfied (Y in S56), the first evacuation process is finished.

Subsequently, the evacuation process control unit 84 executes the second evacuation process. The second evacuation process includes a second rough pumping step (S58) and a second vacuum condition evaluation (S60). By the second rough pumping step, the cryopump 10 is evacuated from the medium pressure to the base pressure. By the second vacuum condition evaluation, whether the second evacuation process is completed is determined by a second vacuum pumping time evaluation and by a second vacuum retention evaluation. In case that the second vacuum condition is not satisfied (N in S60), the optional purge process control unit 94 executes an optional purge process 6 (S64). In case that the second vacuum condition is satisfied (Y in S60), the second evacuation process is finished. If the first evacuation process and the second evacuation process have completed, the vacuum-exhausting operation of the cryopump 10 can be restarted after the cooling process 7.

Figure 7:
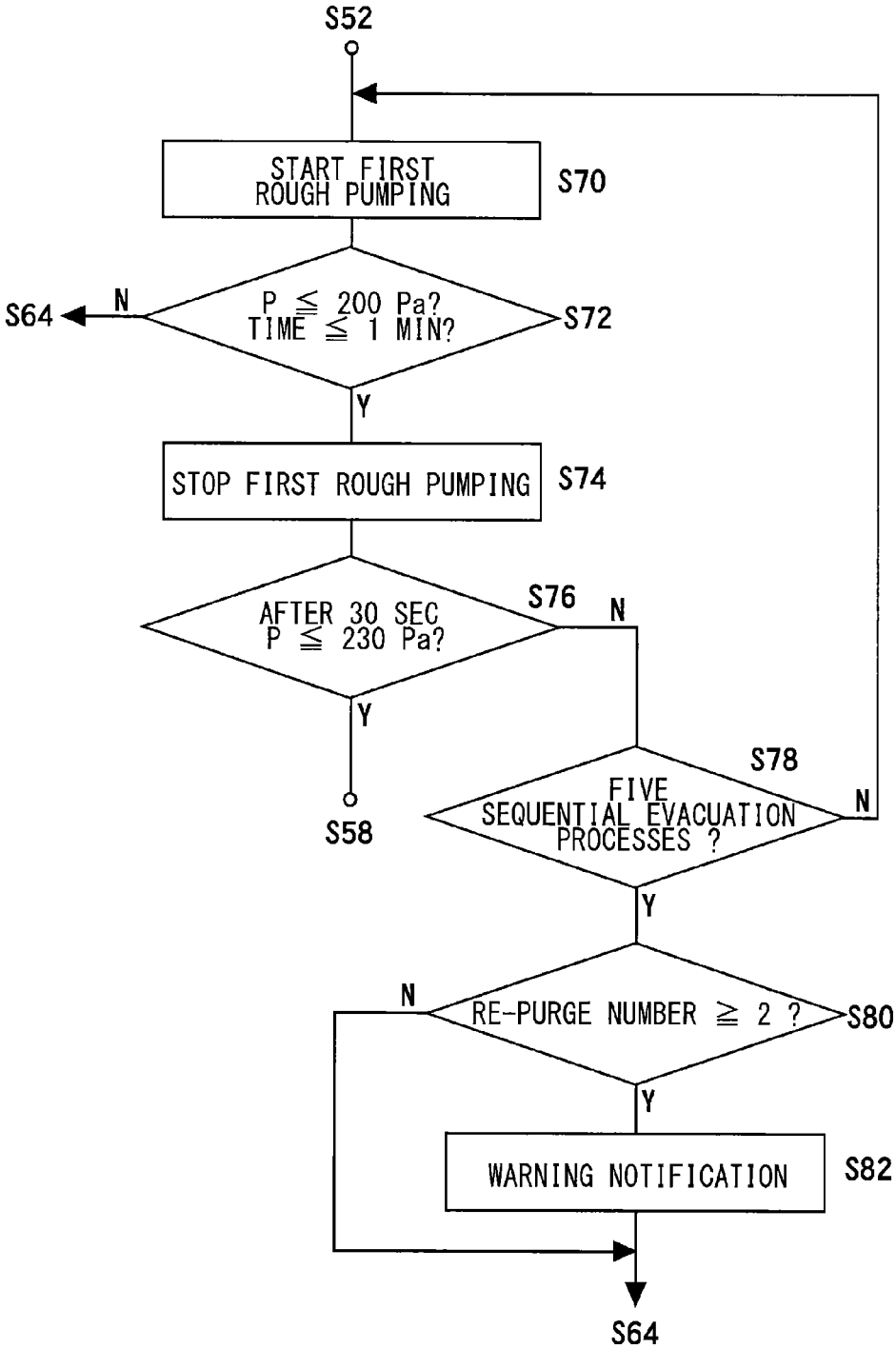
FIG. 7 shows a flowchart indicating in detail a first evacuation process of a variation of the regeneration process of a cryopump according to an exemplary embodiment.

FIG. 7 shows in detail a first evacuation process of a variation of the regeneration process 1 of the cryopump 10 according to an exemplary embodiment. The evacuation process control unit 84 opens the rough valve 72 and allows the rough pump 70 to start evacuating the pump housing 36 (S70). The evacuation process control unit 84 executes the first vacuum pumping time evaluation, which determines whether the inside of the cryopump 10 is pumped down to the medium pressure by the time when a predetermined time period has elapsed after starting pumping (S72). More specifically, it is determined whether the inside of the cryopump 10 is pumped down for example to 200 Pa or less within one minute after starting pumping.

In case the evacuation process control unit 84 determines that the vacuum pumping time condition is not satisfied (N in S72), the optional purge process control unit 94 executes an optional purge process 6 (S64 in FIG. 6). In case the evacuation process control unit 84 determines that the vacuum pumping time condition is satisfied (Y in S72), the evacuation process control unit 84 closes the rough valve 72 so as to stop the pumping (S74). Subsequently, the evacuation process control unit 84 executes the first vacuum retention evaluation (S76). More specifically, it is determined whether the inside of the cryopump is pumped down for example to 230 Pa or less when 30 seconds has elapsed after stopping pumping.

In case that the evacuation process control unit 84 determines that the first vacuum retention condition is not satisfied (N in S76), the optional purge process control unit 94 determines whether or not the optional purge process 6 is required on the basis of the sequential execution number of the first evacuation process (S78). In case that the sequential execution number of the first evacuation process has not reached a first additional purge requiring criteria number (N in S78), the optional purge process control unit 94 determines not to execute an optional purge process 6. The first additional purge requiring criteria number is determined, for example within the range of 1-20 times, and for example is determined as 5. In this case, the evacuation process control unit 84 executes the first evacuation process once more (S70).

On the other hand, in case that the sequential execution number of the first evacuation process has reached the first additional purge requiring criteria number (Y in S78), the optional purge process control unit 94 determines to execute an optional purge process 6. The deterioration evaluation unit 88 determines whether or not a re-purge number determined to be necessary in the first evacuation process is more than or equal to a first deterioration evaluation criteria number (S80). The first deterioration evaluation criteria number is, for example, two. In case that the re-purge number determined to be necessary in the first evacuation process is more than or equal to a first deterioration evaluation criteria number (Y in S80), the transmission unit 96 sends a warning signal to the vacuum apparatus 110 (S82). The optional purge process control unit 94 executes an optional purge process 6, accordingly (S64 in FIG. 6). If the re-purge number has not reached the first deterioration evaluation criteria number (N in S80), no warning is sent. Also in this case, the optional purge process control unit 94 executes an optional purge process 6 (S64 in FIG. 6).

In case the evacuation process control unit 84 determines that the first vacuum retention condition is satisfied (Y in S76), the evacuation process control unit 84 finishes the first evacuation process and starts the second evacuation process (S58 in FIG. 6).

Figure 8:
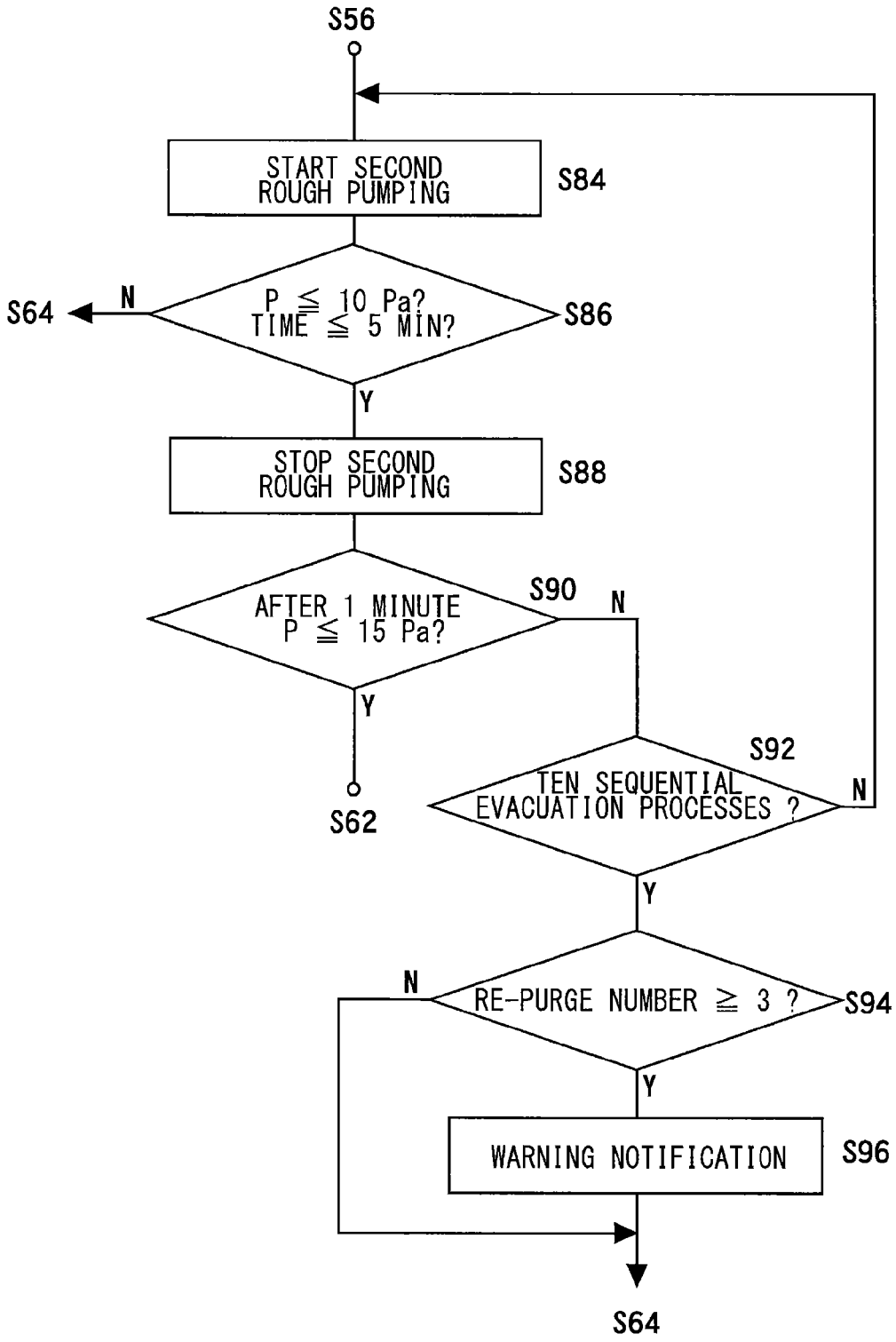
FIG. 8 shows a flowchart indicating in detail a second evacuation process of a variation of the regeneration process of a cryopump according to an exemplary embodiment.

FIG. 8 shows in detail the second evacuation process of a variation of the regeneration process 1 of the cryopump 10 according to an exemplary embodiment.

The evacuation process control unit 84 opens the rough valve 72 and allows the rough pump 70 to start evacuating the pump housing 36 (S84). The evacuation process control unit 84 executes the second vacuum pumping time evaluation, which determines whether the inside of the cryopump 10 is pumped down to the base pressure by the time when a predetermined time period has elapsed after starting pumping (S86). More specifically, it is determined for example whether or not the inside of the cryopump 10 is pumped down to less than or equal to the base pressure within five minute after starting pumping. The base pressure is determined, for example within the range of 1-50 Pa. According to one example, the base pressure is about 10 Pa.

In case that the evacuation process control unit 84 determines that the vacuum pumping time condition is not satisfied (N in S86), the optional purge process control unit 94 executes an optional purge process 6 (S64 in FIG. 6). In case the evacuation process control unit 84 determines that the vacuum pumping time condition is satisfied (Y in S86), the evacuation process control unit 84 closes the rough valve 72 so as to stop the pumping (S88). Subsequently, the evacuation process control unit 84 executes the second vacuum retention evaluation, which determines whether rise of pressure when a predetermined time period has passed after stopping the pumping is within a predetermined allowable range (S90). The upper limit of the allowable rise of pressure is determined for example within the rage of 1-50 Pa. According to one example, the upper limit may be determined to be about 5 Pa. For example, in case of defining the base pressure as 10 Pa and the upper limit of the allowable rise of pressure is defined as 5 Pa, the evacuation process control unit 84 determines whether or not the pressure in the cryopump after 1 minute is equal to or less than 15 Pa.

In case that the evacuation process control unit 84 determines that the second vacuum retention condition is not satisfied (N in S90), the optional purge process control unit 94 determines whether or not the optional purge process 6 is required on the basis of the sequential execution number of the second evacuation process (S92). In case that the sequential execution number of the second evacuation process has not reached a second additional purge requiring criteria number (N in S92), the optional purge process control unit 94 determines not to execute an optional purge process 6. The second additional purge requiring criteria number is determined, for example within the range of 1-20 times, and for example is determined as 10. In this case, the evacuation process control unit 84 executes the second evacuation process once more (S84).

On the other hand, in case that the sequential execution number of the second evacuation process has reached the second additional purge requiring criteria number (Y in S92), the optional purge process control unit 94 determines to execute an optional purge process 6. The deterioration evaluation unit 88 determines whether or not a re-purge number determined to be necessary in the second evacuation process is more than or equal to a second deterioration evaluation criteria number (S94). The second deterioration evaluation criteria number is, for example, three. In case that the re-purge number determined to be necessary in the second evacuation process is more than or equal to a second deterioration evaluation criteria number (Y in S94), the transmission unit 96 sends a warning signal to the vacuum apparatus 110 (S96). Then the optional purge process control unit 94 executes an optional purge process 6, accordingly (S64 in FIG. 6). If the re-purge number has not reached the second deterioration evaluation criteria number (N in S94), no warning is sent. Also in this case, the optional purge process control unit 94 executes an optional purge process 6 (S64 in FIG. 6).

In case the evacuation process control unit 84 determines that the second vacuum retention condition is satisfied (Y in S90), the evacuation process control unit 84 finishes the second evacuation process. Then the cooling process 7 is started (S62 in FIG. 6).

In this manner, when the evacuation process 5 is executed in two steps, the deterioration evaluation may be executed for respective steps, separately. Thereby, the necessity of maintenance can be detected, and possible defect parts in the cryopump 10 can be narrowed down.

Given above is an explanation based on the exemplary embodiment. The exemplary embodiment described above is intended to be illustrative only and it will be obvious to those skilled in the art that various modifications could be developed and that such modifications are also within the scope of the present invention.

According to the exemplary embodiment, an explanation has been given on an example where the deterioration status of the cryopump 10 is monitored by using the re-purge number. However, the deterioration status of the cryopump 10 may be monitored by using another parameter of the regeneration process 1. For example, heating time required for the heating process 3 of the regeneration process 1 and the cooling time required for the cooling process 7 after finishing the regeneration process 1 may be used as the parameter. In this case, the heating process control unit 86 determines whether or not an actual heating time in the regeneration process 1 is longer than a heating deterioration criteria time, and if the actual heating time is longer than the heating deterioration criteria time, the transmission unit 96 sends a warning. In a similar manner, the heating process control unit 86 determines whether or not an actual cooling time in the regeneration process 1 is longer than a cooling deterioration criteria time, and if the actual cooling time is longer than the cooling deterioration criteria time, the transmission unit 96 sends a warning.

The heating time is, for example, a necessary time period in the regeneration process 1 after the refrigerator 20 stops cooling operation and starts reverse rotation operation, and until the temperature of the cryopump 10 reaches the regeneration temperature. The cooling time is, for example, a necessary time period after the regeneration process 1 is completed and the refrigerator 20 starts cooling operation, and until the temperature of the cryopanels 48 is cooled down to a predetermined operating temperature of the cryopump.

The heating deterioration criteria time and the cooling deterioration criteria time may be defined for respective models of the cryopumps 10, or may be calculated by multiplying an averaged heating time or averaged cooling time by a predetermined factor. The averaged heating time or the averaged cooling time may be the average of heating times or a cooling times of regeneration processes 1, which are executed during a certain period (e.g., about one-week to one-month) after a new cryopump 10 starts operation. The predetermined factor may be, for example 1.5 to 2. In defining the averaged heating or cooling time, a certain period (e.g., about one week to one month) after a new cryopump 10 is connected to a vacuum apparatus 110 and starts operation may be omitted from the period for measuring the heating or cooling time for calculating an averaged value. In this case, heating or cooling time measured during a certain period after the omitted period may be measured for calculating the averaged value.

According to the variation of the exemplary embodiment, deterioration status of a cryopump 10 can be monitored by using a measured value of heating time and cooling time of the regeneration process 1 and the start-up process 2 thereafter that are executed as a part of usual operation cycle of the cryopump 10. Thereby, without particularly spending time to inspections and without providing a particular apparatus for monitoring, the necessity of maintenance can be detected in advance, and the occurrence of sudden downtime of the vacuum apparatus 110 can be suppressed.

A combination of the monitoring by using the re-purge number and the monitoring by using the heating time and the cooling time may also be performed. In this case, using a plurality of parameters together enables the implementation of more detailed monitoring, such as, not only the detection of the necessity of maintenance but also narrowing down of possible defect parts in the cryopump 10, and prediction of a component that is required to be replaced.

It should be understood that the invention is not limited to the above-described embodiment, but may be modified into various forms on the basis of the spirit of the invention. Additionally, the modifications are included in the scope of the invention.

Priority is claimed to Japanese Patent Application No. 2011-132685, filed Jun. 14, 2011, the entire content of which is incorporated herein by reference.

What is claimed is:

1. A cryopump control apparatus controlling a cryopump that comprises a cryopanel which cools and thus condenses or adsorbs gas, and a pump housing which contains the cryopanel, wherein a regeneration process of the cryopump includes: a basic purge process that includes one or more gas purge steps; one or more evacuation processes that first evacuate the pump housing down to a vacuum retention evaluation level and evaluate a vacuum retention state; and an optional purge process that includes one or more gas purge steps executed once or more than once if necessary, and the cryopump control apparatus comprises a deterioration evaluation unit operative to determine whether a re-purge number, which is the total number of one or more gas purge steps included in one or more optional purge processes that is required to be executed in one regeneration process, reaches a deterioration evaluation criteria number.

2. The cryopump control apparatus according to claim 1, wherein the deterioration evaluation unit determines whether a re-purge number averaged for a plurality of regeneration processes reaches the deterioration evaluation criteria number.

3. The cryopump control apparatus according to claim 1, further comprising:

an evacuation process control unit; and an optional purge process control unit operative to determine whether the optional purge process is required, wherein in case that the evacuation process control unit determines, in the determination of the vacuum retention state, that the vacuum retention state in the pump housing does not satisfy the vacuum retention condition, the evacuation process control unit determines to execute the evacuation process once more, and wherein in case that a sequential execution number of the evacuation process reaches an additional purge requiring criteria number, the optional purge process control unit determines to execute an optional purge process.

4. The cryopump control apparatus according to claim 1, further comprising a transmission unit operative, if the deterioration evaluation unit determines that a re-purge number reaches the deterioration evaluation criteria number, to transmit a warning.

5. A cryopump system comprising:

a cryopump that comprises a cryopanel which cools and thus condenses or adsorbs gas, and a pump housing which contains the cryopanel, wherein a regeneration process of the cryopump includes: a basic purge process that includes one or more gas purge steps; one or more evacuation processes that first evacuate the pump housing down to a vacuum retention evaluation level and evaluate a vacuum retention state; and an optional purge process that includes one or more gas purge steps executed once or more than once if necessary; and a cryopump control apparatus that controls the cryopump, wherein the cryopump control apparatus comprises a deterioration evaluation unit operative to determine whether a re-purge number, which is the total number of one or more gas purge steps included in one or more optional purge processes that is required to be executed in one regeneration process, reaches a deterioration evaluation criteria number.

6. The cryopump system according to claim 5 further comprising a vacuum apparatus to which the cryopump is connected in order to evacuate gas, wherein the cryopump control apparatus further comprises a transmission unit that transmits a warning in case that the deterioration evaluation unit determines that a re-purge number reaches the deterioration evaluation criteria number, and the vacuum apparatus executes a predetermined process upon receiving the warning transmitted from the transmission unit.

7. A method for monitoring a cryopump that comprises a cryopanel which cools and thus condenses or adsorbs gas, and a pump housing which contains the cryopanel, wherein a regeneration process of the cryopump includes: a basic purge process that includes one or more gas purge steps; one or more evacuation processes that first evacuate the pump housing down to a vacuum retention evaluation level and evaluate a vacuum retention state; and an optional purge process that includes one or more gas purge steps executed once or more than once if necessary, the method comprising determining whether a re-purge number, which is the total number of one or more gas purge steps included in one or more optional purge processes that is required to be executed in one regeneration process, reaches a deterioration evaluation criteria number.

* * * * *